US006852164B2

(12) United States Patent
Krämer

(10) Patent No.: US 6,852,164 B2
(45) Date of Patent: Feb. 8, 2005

(54) POWDER SUPPLY SYSTEM FOR COATING INSTALLATIONS WITH A PLURALITY OF APPLICATION UNITS

(75) Inventor: Erich Krämer, Michelau (DE)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/287,344

(22) Filed: Nov. 4, 2002

(65) Prior Publication Data

US 2003/0075104 A1 Apr. 24, 2003

Related U.S. Application Data

(63) Continuation of application No. 09/700,815, filed as application No. PCT/EP99/03524 on May 21, 1999, now abandoned.

(30) Foreign Application Priority Data

May 22, 1998 (DE) ..... 198 23 068

(51) Int. Cl.[7] ..... B05C 5/00
(52) U.S. Cl. ..... 118/308; 118/612
(58) Field of Search ..... 118/308, 309, 118/408, DIG. 5, 610, 612, 608; 406/136, 138, 144, 145, 93; 222/144, 145.5, 195, 145; 239/654, 8, 359; 34/359

(56) References Cited

U.S. PATENT DOCUMENTS 5,159,765 A * 11/1992 Kramer ..... 34/359

FOREIGN PATENT DOCUMENTS

| | | |
|---|---|---|
| DE | 295 18 478 U | 1/1996 |
| DE | 195 17 229 A | 11/1996 |
| DE | 195 38 926 A | 4/1997 |
| EP | 0 689 875 A | 1/1996 |

* cited by examiner

*Primary Examiner*—Brenda A. Lamb
*Assistant Examiner*—Yewebdar T. Tadesse
(74) *Attorney, Agent, or Firm*—Calfee, Halter & Griswold LLP

(57) ABSTRACT

A central powder supply system, referred to as a so-called powder center (1) is made available for use especially in high-performance industrial powder coating installations. The powder center (1) is divided into two separate chambers (2, 3), an operating chamber (2) and a powder chamber (3). Both chambers (2, 3) can be connected with a powder separating device via an opening which can be closed off. The powder chamber (3) essentially houses the powder preparation device (5), while the operating chamber (2) contain the operating parts (22) and supply parts (20, 21). The powder preparation device (5) comprises a height-adjustable lifting table (7) with vibration device for the powder supply container (6 positioned thereon. In addition, there is a suction plate (12) which serves as suction device and has through openings (13). The suction plate (12) is surrounded by a strain basket (17) which, optionally, has a support basket (18). Provided at a distance thereto is a fluidizing device (14) which is configured in a basket-like manner and in which the strain basket (17) and, optionally, the support basket (18) are arranged one inside the other. The powder center permits a rapid and substantially automatic cleaning during change of powder.

19 Claims, 2 Drawing Sheets

POWDER SUPPLY SYSTEM FOR COATING INSTALLATIONS WITH A PLURALITY OF APPLICATION UNITS

CROSS-REFERENCES TO RELATED APPLICATIONS

This application is a continuation of prior filed application application. Ser. No. 09/700,815, filed Nov. 20, 2000, now abandoned which in turn is the national stage application of PCT International application no. PCT/EP99/03524, filed May 21, 1999, which was not published in English and which designated the United States, the disclosure of which is hereby incorporated by reference.

This application claims the priority of German Patent Application Serial No. 198 23 068.0, filed May 22, 1998, pursuant to 35 U.S.C. 119(a)–(d), the disclosure of which is incorporated herein by reference.

BACKGROUND OF THE INVENTION

The invention relates to a powder supply system for powder coating installations, in particular for high-performance commercial-scale installations for powder application.

Powder supply systems for powder coating installations are used for fluidizing powder stored in a container and for supplying the fluidized powder to associated powder application units, such as powder guns and the like.

In high-performance commercial-scale powder coating installations, several powder application units or several groups of powder application units can be supplied by a common powder supply system. This requires a powerful powder supply system, a so-called powder center. Advantageously, the powder delivery vessel should be used directly with such a powder center for supplying and processing powder. At the same time, cleaning during a powder change should be performed as quickly, reliably and completely as possible, preferably automatically.

SUMMARY OF THE INVENTION

It is a therefore an object of the invention to provide a powder supply system which satisfies the requirements of high-performance commercial-scale powder coating installations and permits a substantially automatic operation of a powder coating installation, including its cleaning.

According to one aspect of the invention a powder supply system for powder coating installations is provided which can be used for centrally supplying with powder several powder application units or several groups of powder application units. Unlike prior art suction tubes, which transport the fluidized powder to the application units with injectors, the powder supply system of the invention which will subsequently also be referred to as "powder center", is provided with a novel suction device. This suction device is formed as a rigid plate, preferably made of a light metal, such as aluminum, and has through openings which completely penetrate the plate and form individual suction tubes. Preferably, the suction plate of the invention includes at least two through openings extending parallel to a width of the plate.

To provide a high-performance commercial-scale system for powder processing, the powder center of the embodiment of the invention includes a basket-like fluidizing device which surrounds the outside of this suction plate. This basket-like fluidizing device has on its end that faces a powder container, fluidizing hoses which extend in the direction of the width and have individual fluidizing openings for supplying fluidizing air.

In order to prevent the formation of clumps during powder processing, a so-called strain basket can be placed between the basket-like fluidizing device and the suction plate, with the strain basket fabricated of a strain matting, a perforated plate or the like and arranged between the basket-like fluidizing device and the suction plate. To prevent the strain basket from bowing, a support basket can be placed between the suction plate and the strain basket.

In an advantageous embodiment of the powder center of the invention, the plate-like suction device or the suction plate are mounted stationarily, whereas the arrangement including the basket-like fluidizing units and the strain basket as well as optionally also the support basket are disposed releasably in the powder center. In this way, the assembly comprised of the basket-like fluidizing device and the strain basket as well as optionally also the support basket form a nested arrangement and can hence be separately removed from the suction plate.

Moreover, the arrangement of the basket-like fluidizing unit, the strain basket and optionally the support basket are supported on the releasable attachment points so as to be able to perform a vibration motion. Advantageously, the basket-like fluidizing unit, the strain basket and optionally the support basket are supported on an oscillating frame. The oscillating frame is advantageously supported around the attachment end of the suction plate.

According to another aspect of the invention, the suction plate as well as the functionally associated assemblies, such as the basket-like fluidizing unit, the strain basket and optionally the support basket of a powder supply system are stationary.

For receiving the powder storage container, which can be formed, for example, by a delivery vessel, the powder center according to the invention includes a lifting table, which supports the powder container, such as the delivery vessel, wherein the lifting table is constructed so as to be able to perform suitable oscillations and/or vibrations so that a vibration motion can be impressed on the powder in the powder storage container for the purpose of loosening the powder. In this embodiment, the table support for the powder supply container is movable and hence implemented as a lifting table. With the help of a suitable lifting device, the lifting table can be raised to the operating position in the direction of the stationary assembly which includes the suction plate, the basket-like fluidizing unit, the strain basket and optionally the support basket.

Optionally, an automatic pre-cleaning device that can be placed under the support table of the lifting table or separately mountable on the lifting table and preferably includes conical blow-off nozzles, can be provided. This automatic pre-cleaning device is intended to facilitate the cleaning during a powder change, wherein when the lifting table is raised, the conical blow-off nozzles due to their conical shape form a sealing connection with the through openings of the suction plate when the powder supply container and the assembly of the basket-like fluidizing device, the strain basket and optionally the support basket are removed. In this way, the through openings and possibly fittings and host connections connected thereto can be blown out and cleaned. This automatic pre-cleaning device can also be provided as a separate unit which can be suitably installed on the lifting table for the cleaning operation. Alternatively, the pre-cleaning device can also be integrated with the lifting table.

According to another aspect of the invention, the powder supply center is subdivided into two mutually independent chambers. One chamber holds the powder processing unit and the powder supply unit with the suction plate, the basket-like fluidizing unit, the strain basket and optionally the support basket, and the powder storage container, such as the delivery vessel. A separate second chamber holds the operating devices, such as the injector device, control devices therefor and connections for the powder application units. Advantageously, the control devices and functional elements required for the operation are combined in a header plate to which the connections for the media supply units are attached. The header plate also includes through bores which are in communicating connection with the through openings in the suction plate. In addition, supply lines for fluidizing air, which are connected with the basket-like fluidizing device, pass through the header plate and are operatively connected to the corresponding supply units via associated control devices. The second chamber which can also be referred to as operating chamber to differentiate this chamber from the powder processing chamber, can include a steam arrangement of control devices to allow corresponding adjustments for the supply media of the powder supply center. These control devices can be combined in an operating field.

According to another aspect of the invention, the individual chambers of such an arrangement of a powder supply center with two separate chambers are connected through a closable opening and an associated conduit with the powder separation unit of the powder application unit. For cleaning and also during operation, the two separate chambers, the powder chamber and the operating chamber, can be suctioned off separately, whereby the powder can be removed from these chambers effectively and automatically, in particular, during a powder change.

The lifting operation of the lifting table can be produced by suitable lifting devices, such as cylinder units, spindle units and the like.

It will be understood that other embodiments and modifications can be implemented within the framework of the invention. The suction plate provided with the powder center of the invention can also be made movable, allowing the powder storage container to rest on top during a vibration motion.

Of course, the implementation of the powder processing unit, which includes for example the suction plate, the basket-like fluidizing device, the strain basket and optionally the support basket, can also be used with other powder supply units without incorporating all the aspects of the invention that are essential for the powder center.

Subdividing the powder center into two separate chambers, a so-called powder chamber and an operating chamber facilitates operation and monitoring of the powder center of the invention. More particularly, the powder coating installation can be operated so that as little powder as possible escapes into the atmosphere.

It is important that the components of the powder center of the invention that form a part of the powder center can be cleaned automatically or at least semi-automatically. This simplifies considerably the cleaning operation required during a powder change, and these operations can be performed rapidly and substantially automatically. It is important during a powder change that the old powder charge is removed from all powder-carrying units as completely and quickly as possible, so that powder coating can be resumed quickly with a new powder charge without the risk of contamination by the residual powder which could result in coatings of a lesser quality.

BRIEF DESCRIPTION OF THE DRAWING

A preferred embodiment of the invention will be described hereinafter with reference to the appended drawings. It is shown in FIG. 1 a schematic perspective view of a preferred embodiment of a powder supply system according to the invention.

DETAILED DESCRIPTION OF PREFERRED EMBODIMENTS

Figure 1:
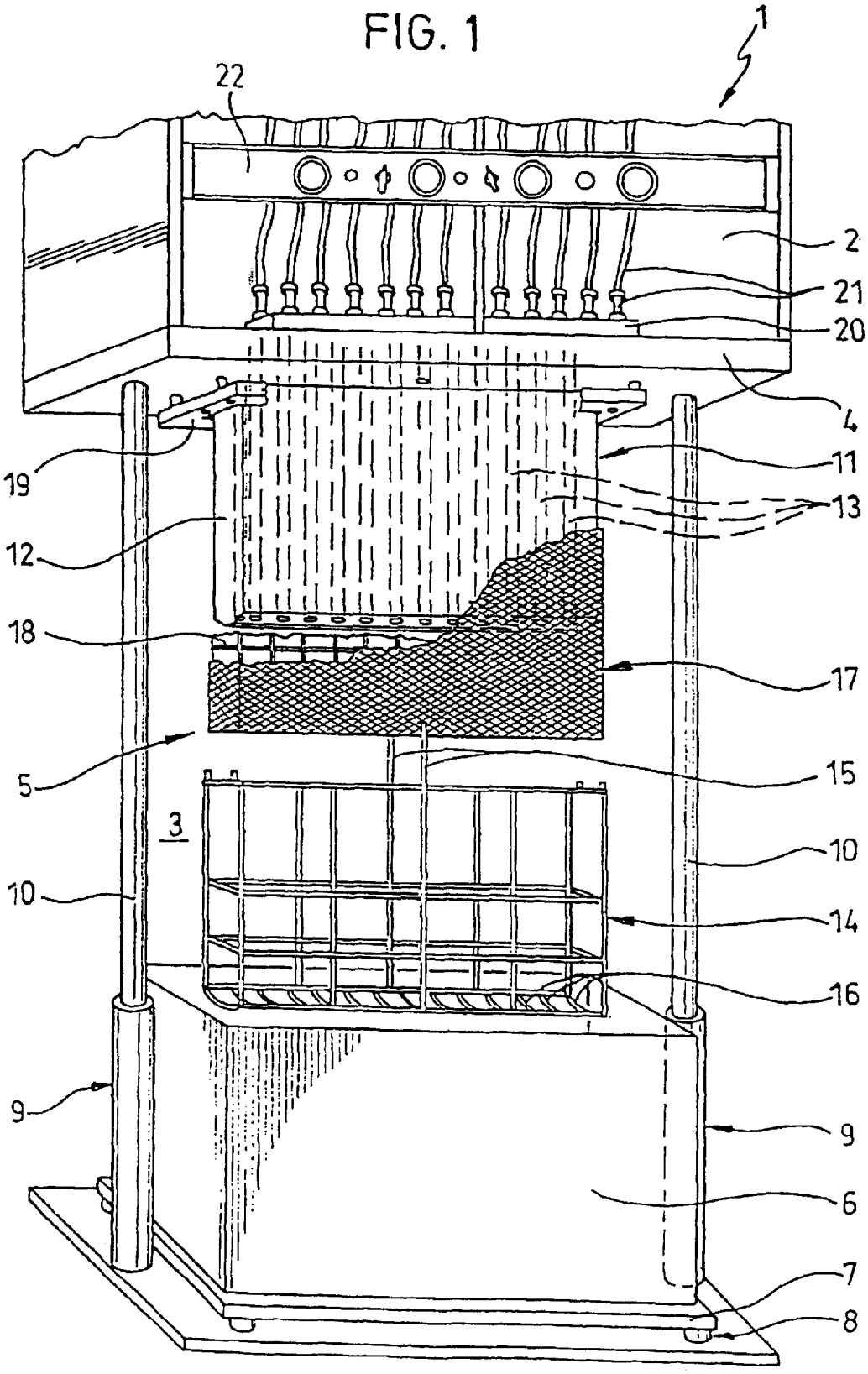

Referring now to FIG. 1, a preferred embodiment of a central powder supply system, abbreviated as "powder center", is illustrated. The powder center 1 includes a first chamber 2, a so-called operating chamber, which is shown in a top portion of the Figure. Separately, a second lower chamber 3, a so-called powder chamber, it is provided. The two superpositioned chambers 2 and 3 are separated by a common separation wall 4.

The core component of the powder processing installation of the powder center 1 is arranged in the powder chamber 3 and the powder processing chamber 3, respectively. The powder processing installation as a whole has the reference numeral 5.

In the illustrated preferred embodiment, the powder storage container 6, such as the delivery vessel, is positioned on a table 7 and/or a tabletop. A vibrating device is disposed between a base plate and the table 7, with the table 7 causing the powder in the powder storage container 6 to perform a vibration motion for the purpose of loosening the powder. The table 7 can be moved up and down along guides 10 by a lifting device 9.

A suction device 11 is attached on the side of the separation wall 4 facing the powder chamber 3. The suction device 11 has the form of a suction plate 12 which is preferably fabricated from a light metal, such as aluminum and the like. The suction plate 12 forming the suction device 11 has through openings 13 which completely and continuously extend through the suction plate 12. Preferably, the through openings 13 are arranged mutually parallel in pairs along the width of the suction plate 12.

As shown more clearly in the expanded view of FIG. 1, the powder processing installation further includes a fluidizing device 14 which has the form of a basket and surrounds the suction plate 12 with a gap therebetween. The fluidizing device 14 includes fluidizing supply lines 15 which are connected with fluidizing elements 16 of the basket-like fluidizing device 14. The fluidizing elements 16 are in tubular form and extend along the width of the basket and the suction plate 12 and contain several openings to provide an exit for the fluidizing air.

As seen from FIG. 1, a strain basket 17 formed of a wire mesh with a suitable mesh size is disposed between the basket-like fluidizing device 14 and the suction plate 12. To prevent the strain basket 17 from bowing and to be able to select the greatest possible mesh size for the material of the strain basket 17, the inside of the strain basket can be reinforced by a support basket 18. The support basket 18 then surrounds the suction plate 12 with a gap therebetween.

In the illustrated embodiment, the strain basket 17 and the support basket 18 are constructed so as to be received in the basket-like fluidizing device in form of a nested arrangement. This arrangement of the basket-like fluidizing device 14, the strain basket 17 and, optionally, the support basket 18 is releasably attached to the separation wall 4. In addition, an oscillating or vibration motion is impressed on this arrangement in the installed state by an oscillating frame 19 which is secured to the separation wall 4 and surrounds the suction plate 12. The arrangement of the basket-like fluidizing device 14, the strain basket 17 and, optionally, the support basket 18 can be attached to the oscillating frame 19. Any clumps that may exist during the powder processing can be dissolved with the help of the strain basket 17, so that the strain basket 17 functions as a kind of "de-clumping" device.

The first chamber 2 or operating chamber 2, respectively, houses the operating facilities, such as the control devices and supply devices for the powder processing installation (not shown). A connecting and distribution plate 20 is connected to the surface of the separation wall 4 that faces the operating chamber. The distribution plate 20 includes through bores which are in communicating connection with the through openings 13 of the suction plate 12. The hose fittings 21 for the operating media are indicated on the top side of the distribution plate 20. Also organized on the distribution plate 20 are the injectors for conveying the processed powder to the powder coating installations.

The operating chamber 2 also includes, for example, a control field 22 with corresponding control and display elements required for adjusting the operation of the operating media which are housed in the operating chamber 2. The control and display elements arranged on the control field 22 include a hopper control device which is provided on the powder center 1 for adjusting the desired operating conditions. The basic control functions are performed separately by separate switching devices.

Figure 2:
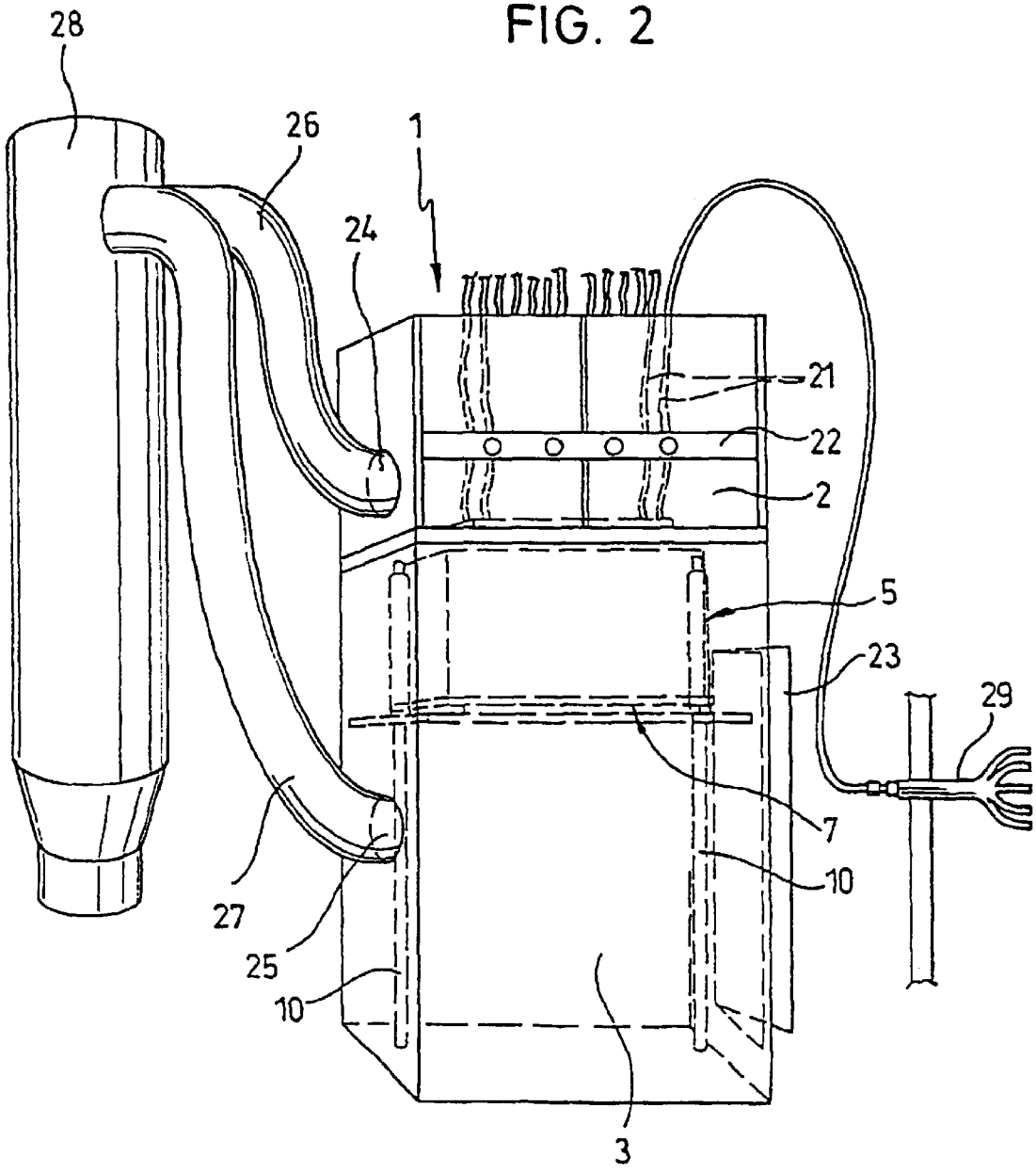
FIG. 2 a schematic view of a powder coating installation with a central powder supply system according to FIG. 1 and, as indicated schematically, with a powder coating installation and subsequent powder separation unit, for example in the form of a cyclone.

As also seen from FIG. 2, the operating chamber 2 and the powder chamber 3 are closed tightly on all sides, with access doors 23 being provided at suitable locations. In addition, closable openings 24, 25 are provided in the walls of the two chambers 2, 3, wherein the openings 24, 25 are connected by connecting lines 26, 27 to a powder separation device 28 that forms a part of the entire powder coating installation. The powder separation device 28 is illustrated, for example, in FIG. 2 as a cyclone. Shown schematically in FIG. 2 is one of a plurality of powder coating installations 29 which is connected to the powder supply center 1, as schematically indicated.

FIG. 2 depicts the powder supply center 1 in its operating position, where the lifting table 7 with the powder storage container 6 is raised relative to the position indicated in FIG. 1 in such a way that the assembly formed by of the suction plate 12, the fluidizing device 14, the strain basket 17 and, optionally, the support basket 18 is immersed into the powder of the powder storage container.

If the powder has to be cleaned off for a new powder change, then the closable openings 24, 25 of the two chambers 2, 3 can be opened and any residual powder remaining in these chambers 2, 3 can be transported to the powder separation device 28.

Although not shown in the drawings, an automatic pre-cleaning device can be provided which can be either integrated with the lifting table 7 or provided separately therefrom, with the ends of the pre-cleaning device having conical blow-off nozzles. For automatic pre-cleaning, the powder supply container 6 is removed from the lifting table 7 and the arrangement, which includes the basket-like fluidizing device 14, the strain basket 17 and, optionally, the support basket 18, is removed from the oscillating frame 10. The lifting table is then raised together with the operational blow-off nozzles in the direction of the suction plate 12, with the conical blow-off nozzles forming a seal with the through openings 13 of the suction plate 12. The through openings 13 and the associated devices for pre-cleaning are then blown out with compressed air.

The pre-cleaning device can also be a device separate from the table 7 and can optionally be mounted on the lifting table in a suitable manner.

In summary, the invention provides a central powder supply system, a so-called powder center, intended particularly for high-performance commercial-scale installations for powder coating. The powder center is subdivided into two separate chambers, an operating chamber and a powder chamber. Most chambers can be connected through closable openings with a powder separation device. The powder processing device is essentially arranged In the powder chamber, whereas the operational elements and the supply elements are combined in the operating chamber. The powder processing device includes an adjustable lifting table with a vibration device for the powder storage container resting of the lifting table. Also provided as a suction device is a suction plate with through openings. This suction plate is surrounded by a strain basket which can optionally have a support basket. Spaced apart therefrom is the fluidizing device which is in the form of a basket, with the strain basket and, optionally, the support basket forming a nested arrangement. The arrangement formed of the fluidizing device, the strain basket and, optionally, the support basket is releasably arranged in the powder chamber and connected with an oscillating frame which impresses a vibration motion of on this arrangement. In the powder center, the suction plate is stationary, whereas the lifting table with the storage container is height-adjustable. The powder center enables a rapid and substantially automatic cleaning operation during a powder change and enables high-performance powder processing for commercial-scale powder coating installations.

What is claimed is:

1. Powder supply system for a powder coating installation comprising:

a powder storage container;

a powder fluidizing device that fluidizes powder when positioned in the powder storage container; and a suction device receiving the fluidized powder and supplying the fluidized powder to a powder application device, wherein the suction device is formed as a plate that is generally planar, said plate having through openings extending through the plate.

2. The apparatus of claim 1 wherein said plate is a unitary structure that extends lengthwise along an axis, wherein said through openings extend generally parallel along said axis.

3. The apparatus of claim 1 wherein said fluidizing device comprises a basket-like structure formed of fluidizing elements.

4. The apparatus of claim 3 wherein said fluidizing elements are tubular with a plurality of openings therein for fluidizing air.

5. The apparatus of claim 1 comprising a stain basket that generally surrounds said suction device.

6. The apparatus of claim 5 wherein said strain basket comprises a mesh for de-clumping fluidized powder.

7. The apparatus of claim 6 comprising a support basket for said strain basket, said support basket being disposed inside said strain basket.

8. The apparatus of claim 7 wherein said suction device, strain basket, support basket and fluidizing device are nested together dining a powder supplying operation.

9. The apparatus of claim 6 wherein said suction device, strain basket and fluidizing device are nested together during a powder supplying operation.

10. The apparatus of claim 5 wherein said fluidizing device and strain basket are releasably mounted on a wall.

11. The apparatus of claim 10 comprising an oscillatory frame mounted on said wall, said fluidizing device and strain basket being releasably mounted on said oscillatory frame.

12. The apparatus of claim 11 comprising a support basket nested in said strain basket.

13. The apparatus of claim 10 comprising a support basket nested in said strain basket.

14. Powder supply system for a powder coating installation comprising:

a powder storage container;

a powder fluidizing device that fluidizes powder in the powder storage container;

a suction device receiving the fluidized powder and supplying the fluidized powder to a powder application device, wherein the suction device is formed as a plate that is generally planar; and a strain basket between said suction device and said fluidizing device.

15. The apparatus of claim 14 wherein said fluidizing device is a basket-like frame, said suction device, strain basket and fluidizing device being nested together during a powder supply operation.

16. The apparatus of claim 15 wherein said strain basket and fluidizing device are releasably attached to a wall.

17. The apparatus of claim 16 comprising a support basket inside said strain basket.

18. The apparatus of claim 17 wherein said strain basket comprises a mesh.

19. Powder supply system for a powder coating installation comprising:

a powder storage container;

a basket-like powder fluidizing device that fluidizes powder when positioned in the powder storage container;

a suction plate receiving the fluidized powder and supplying the fluidized powder to a powder application device;

a strain basket between said suction plate and said fluidizing device, wherein said fluidizing device, suction plate and strain basket are nested together during a powder supplying operation.

* * * * *

UNITED STATES PATENT AND TRADEMARK OFFICE

CERTIFICATE OF CORRECTION

PATENT NO. : 6,852,164 B2
DATED : February 8, 2005
INVENTOR(S) : Erich Kramer

It is certified that error appears in the above-identified patent and that said Letters Patent is hereby corrected as shown below:

Column 6,
Line 60, delete the word “stain” and insert -- strain --.
Line 65, delete the word “basket” and insert -- bracket --.

Column 7,
Line 3, delete the word “dining” and insert -- during --.

Signed and Sealed this

Twenty-fourth Day of May, 2005

JON W. DUDAS
*Director of the United States Patent and Trademark Office*